US010381702B2

(12) United States Patent
Alkan

(10) Patent No.: US 10,381,702 B2
(45) **Date of Patent: *Aug. 13, 2019**

(54) MINI ISOLATOR

(71) Applicant: PPC BROADBAND, INC., East Syracuse, NY (US)

(72) Inventor: Erdogan Alkan, Manlius, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/290,216

(22) Filed: Oct. 11, 2016

(65) Prior Publication Data

US 2017/0104255 A1 Apr. 13, 2017

Related U.S. Application Data

(60) Provisional application No. 62/239,685, filed on Oct. 9, 2015.

(51) Int. Cl.
*H01P 1/20* (2006.01)
*H01P 1/36* (2006.01)
(Continued)

(52) U.S. Cl.
CPC ..... *H01P 1/36* (2013.01); *H01P 1/202* (2013.01); *H01P 1/2007* (2013.01); *H01P 1/30* (2013.01);
(Continued)

(58) Field of Classification Search
CPC ..... H03H 1/0007; H01P 1/36; H01P 1/20; H01P 1/2007; H01P 1/202; H01P 3/06
(Continued)

(56) References Cited

U.S. PATENT DOCUMENTS 4,267,529 A † 5/1981 Brun
4,945,318 A † 7/1990 Kabachinski
(Continued)

OTHER PUBLICATIONS

Blaine R. Copenheaver (Authorized Officer), International Search Report and Written Opinion dated Dec. 19, 2016, International Application No. PCT/US2016/056365, filed Oct. 11, 2016, pp. 1-12.

*Primary Examiner* — Stephen E. Jones
(74) *Attorney, Agent, or Firm* — MH2 Technology Law Group LLP

(57) ABSTRACT

A coaxial radio frequency (RF) isolator is disclosed. The isolator includes a first connector that conducts an RF signal received from a first device connected to the isolator. The isolator also includes a conductive body including a second connector and a conductive outer shield that form a first internal cavity. The isolator further includes a dielectric sleeve between the outer shield and the conductive body. In addition, the isolator includes a conductive coupling/filtering member inside the outer shield and the dielectric sleeve. The conductive coupling/filtering member has a cylindrical shape forming a second internal cavity. Moreover, the isolator includes a thru-RF signal transmission path through the first internal cavity and the second internal cavity. The thru-RF signal transmission path receives the RF signal from the first device, conditions the RF signal, and outputs the RF signal to a second device. Further, the isolator includes a coaxial coupling element in the first internal cavity and has a cylindrical shape. The coaxial coupling element connects the conductive body, the conductive filtering/coupling member, and the conductive outer shield. Additionally, the isolator includes a magnetic toroid in the first cavity that surrounds the conductive coupling/filtering member.

34 Claims, 11 Drawing Sheets

(51) Int. Cl.

| | |
|---|---|
| ***H01R 9/05*** | (2006.01) |
| ***H01P 1/202*** | (2006.01) |
| ***H01P 1/30*** | (2006.01) |
| ***H01P 3/06*** | (2006.01) |
| ***H01R 24/42*** | (2011.01) |
| *H01R 24/52* | (2011.01) |

(52) U.S. Cl.
CPC ..... *H01P 3/06* (2013.01); *H01R 9/05* (2013.01); *H01R 24/42* (2013.01); *H01R 24/525* (2013.01)

(58) Field of Classification Search
USPC ..... 333/12, 181, 185, 24 R, 24.2
See application file for complete search history.

(56) References Cited

U.S. PATENT DOCUMENTS

| | | | |
|---|---|---|---|
| 7,749,026 | B1 | 7/2010 | Li et al. |
| 8,734,025 | B2 | 5/2014 | Snyder et al. |
| 8,758,059 | B2 | 6/2014 | Watanabe et al. |
| 8,975,520 | B2 | 3/2015 | Blake et al. |
| 9,028,276 | B2 | 5/2015 | Wilson et al. |
| 9,112,323 | B2 | 8/2015 | Goebel et al. |
| 9,178,317 | B2 | 11/2015 | Holland |
| 9,246,275 | B2 | 1/2016 | Holland et al. |
| 9,444,197 | B2 | 9/2016 | Goebel et al. |
| 9,647,394 | B2 | 5/2017 | Goebel et al. |
| 2011/0248801 | A1 | 10/2011 | Blake et al. |
| 2012/0122329 | A1 | 5/2012 | Montena |
| 2012/0196476 | A1 | 8/2012 | Haberek et al. |
| 2012/0202378 | A1 | 8/2012 | Krenceski et al. |
| 2013/0065433 | A1 | 3/2013 | Burris |
| 2013/0115812 | A1 | 5/2013 | Ehret et al. |

† cited by third party

MINI ISOLATOR

BACKGROUND

In a typical building, ground potential in the electrical systems of the building needs to be equalized for all networks so that different networks function properly. For example, a power line and cable television (CATV) network require equal ground potentials as they utilize common equipment. For developed countries, the ground installation and setup may be regulated, and thus the networks in a building may not experience issues. On the other hand, other jurisdictions where regulation is less, improper grounding may become an issue when different networks have different ground potentials.

When two networks are connected, for example, when a cable is connected to the CATV set top box, a current will flow from CATV network to a neutral line of the set top box or vice versa if the ground potentials are not equal. In some cases, this current may reach levels that damage the set top box, and may even become hazardous to the user or installer. Therefore, the neutral lines of these networks need to be isolated to prevent current flow.

Currently, there are isolators available to address this problem. However, the available isolators are bulky and expensive. For example, in some isolators, isolation is achieved on a printed circuit board that has two ground metallization: one side of the metalization connected to a female connector side and the other side of the metalization to a male connector. The coupling between two ground metalizations is achieved via a coupling capacitor and electromagnetic interference (EMI) filtering is achieved on the printed circuit board from one side metalization to the other using ferrites. This configuration results in large and bulky isolators.

SUMMARY

Embodiments in accordance with the present disclosure provide a coaxial radio frequency (RF) isolator. The isolator includes a first connector that conducts an RF signal received from a first device connected to the isolator. The isolator also includes a conductive body including a second connector and a conductive outer shield that form a first internal cavity. The isolator further includes a dielectric sleeve between the outer shield and the conductive body. In addition, the isolator includes a conductive coupling/filtering member inside the outer shield and the dielectric sleeve. The conductive coupling/filtering member has a cylindrical shape forming a second internal cavity. Moreover, the isolator includes a thru-RF signal transmission path through the first internal cavity and the second internal cavity. The thru-RF signal transmission path receives the RF signal from the first device, conditions the RF signal, and outputs the RF signal to a second device. Further, the isolator includes a coaxial coupling element in the first internal cavity and has a cylindrical shape. The coaxial coupling element connects the conductive body, the conductive filtering/coupling member, and the conductive outer shield. Additionally, the isolator includes a magnetic toroid in the first cavity that surrounds the conductive coupling/filtering member.

Additionally, embodiments in accordance with the present disclosure provide an isolator device. The isolator includes a body having an input connector and an output connector. The isolator can also include an outer shield positioned to surround a portion of the body. The isolator can further include a coupling member electrically coupled to the outer shield and positioned within the outer shield to form a cavity between the outer shield and the coupling member. Additionally, the isolator can include a coaxial circuit surrounding a first portion of the coupling member within the cavity. Further, the isolator can include a toroid surrounding a second portion of the coupling member and positioned within the cavity. Still further the isolator can include a printed circuit board electrically coupled between the input connector and the output connector, wherein the printed circuit board is configured to condition signals communicated between the input connector and the output connector.

Further, embodiments in accordance with the present disclosure provide an isolator including an outer shield, an input connector, and an output connector. The isolator also includes a conditioning circuit that conditions signals communicated between the input connector and the output connector. The isolator further includes a coupling member electrically connected to the output connector. In addition, the isolator includes a coaxial circuit electrically connecting the outer shield to the coupling member, and the coaxial circuit provides ground isolation between the input connector and the output connector.

BRIEF DESCRIPTION OF THE DRAWINGS

Various features of the implementations can be more fully appreciated, as the same become better understood with reference to the following detailed description of the implementations when considered in connection with the accompanying figures, in which.

DETAILED DESCRIPTION

In the following detailed description, references are made to the accompanying figures, which illustrate specific examples of various implementations. Electrical, mechanical, logical and structural changes can be made to the examples of the various implementations without departing from the spirit and scope of the present teachings. The following detailed description is, therefore, not to be taken in a limiting sense and the scope of the present teachings is defined by the appended claims and their equivalents.

According to aspects of the present disclosure, an isolator can be implemented that provides flexibility with EMI filtering, ground coupling, and surge protection outside a main printed circuit board (PCB) assembly. In some implementations, the isolator can be provided with a coaxial PCB with metal contacts plated on the edges of the coaxial PCB. The arrangement of the coaxial PCB allows it to be press-fit in the isolator, which reduces assembly time in manufacturing the isolator. Additionally, because the PCB includes a coaxial design, space utilized by the coaxial PCB in the isolator is reduced. Further, the coaxial PCB can be designed to provide ground connections between two isolated cavities. In some implementations, the isolator includes an EMI filtering cavity, which can include the coaxial PCB and one or more toroids.

Figure 1A:
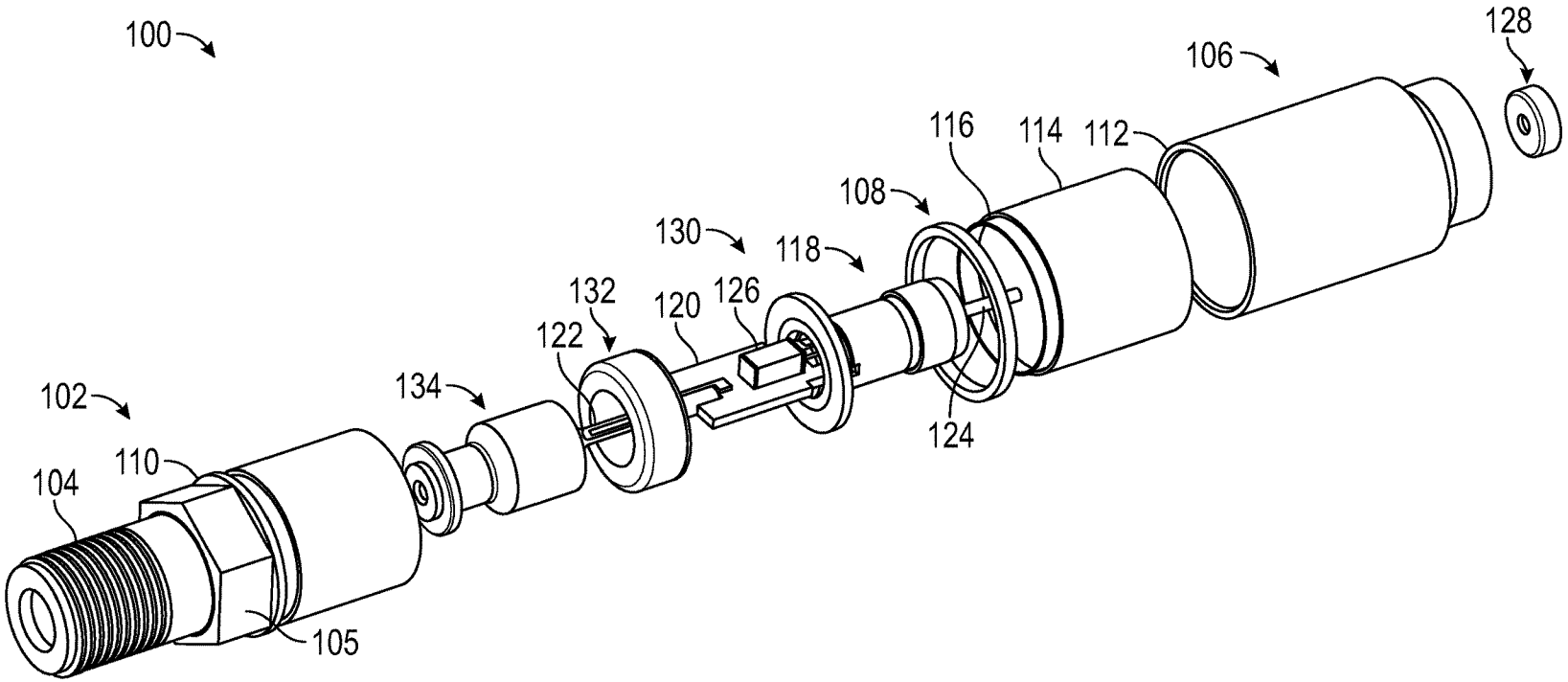
FIG. 1A illustrates an exploded perspective view of example of an isolator, according to various implementations consistent with the present disclosure.
Figure 1B:
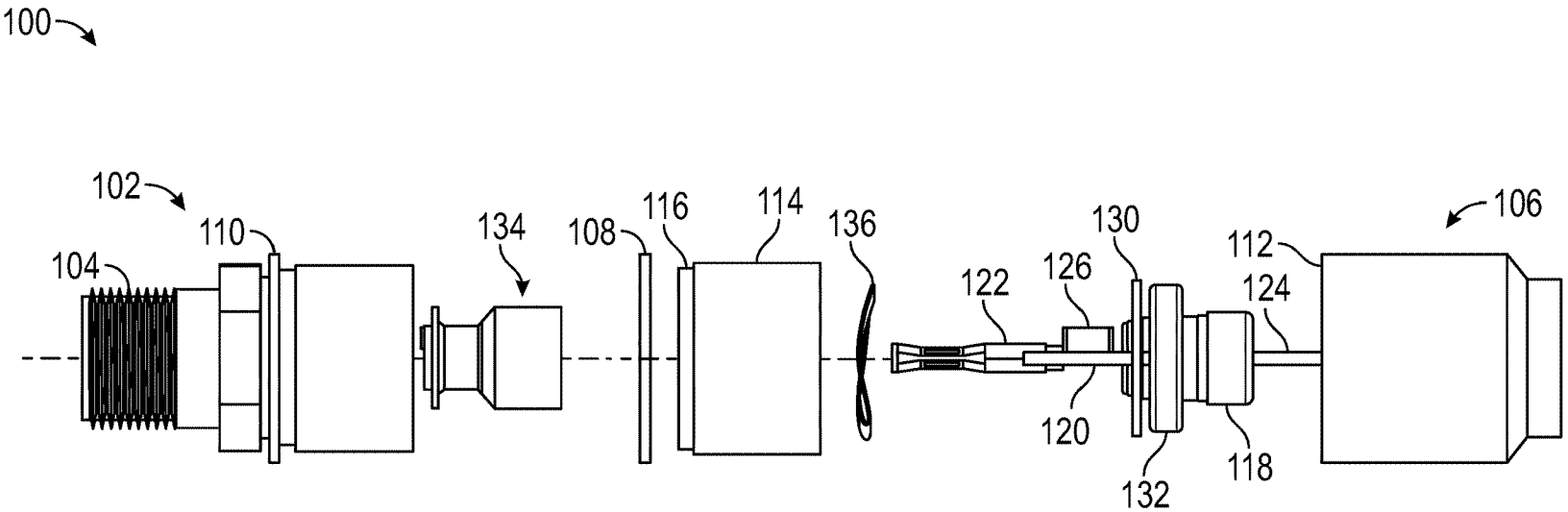
FIG. 1B illustrates an exploded side view of an example of an isolator, according to various implementations consistent with the present disclosure.

FIGS. 1A and 1B illustrate an example of an isolator 100, according to various implementations. In particular, FIG. 1A illustrates an exploded, perspective view of the isolator 100, and FIG. 1B illustrates a side view of the isolator 100. While FIGS. 1A and 1B illustrate various components contained in the isolator 100, it is understood that other implementations can include additional components can be added and existing components can be removed.

The isolator 100 can include a body 102 that includes a connector 104, a threaded nut 105, and an outer shield 106. In some implementations, the connector 104 can be a female connector that includes one or more threads that can connect to, for example, a male connector of a RG-6 coaxial cable. The threaded nut 105 can be screwed onto the threads of the connector. The outer shield 106 can be configured to slide over a portion of the body 102 up to a lip 110. In some implementations, the body 102 and the outer shield 106 to form an internal cavity for the components within the isolator 100. In some implementations, the outer shield 106 can be compression fitted over the body 102 such that the two can be securely attached without the use of, for example, an adhesive material or solder. The body 102 and the outer shield 106 can be formed of a conductor material, for example, a metal or metal alloy. In some implementations, the isolator 100 can also include a spacer 108. The spacer 108 can be formed as a cylindrical ring to be placed over a portion of the body 102. The spacer 108 can be formed a dielectric material, such as a plastic insulator. When the outer shield 106 is compression-fitted over the body 102, the spacer 108 can fit between the lip 110 of the body 102 and an inner lip 112 of the outer shield 106.

In some implementations, the isolator 100 can include a sleeve 114 that includes a peripheral lip 116. The peripheral lip 116 can be formed such that an outer diameter of the sleeve 114 at the peripheral lip 116 is smaller than an outer diameter the remaining portion of the sleeve 114, while the inner diameter of the sleeve 114 is substantially the same over the length of the sleeve 114. The peripheral lip 116 can be configured to receive the spacer 108. The sleeve 114 can be formed of a dielectric material, for example, a plastic insulator. The sleeve 114 can be placed between the outer shield 106 and the body 102. In embodiments, the outer diameter of the peripheral lip 116 can be substantially the same as an inner diameter of the spacer 108. The spacer 108 and the sleeve can create an electrically-insulative barrier between the body 102 and the outer shield 106 that electrically isolates the body 102 from the outer shield 106 when the shield is compression fitted on the body 102.

In some implementations, the isolator 100 can include a coupling/filtering member 118. The coupling/filtering member 118 can be pressed inside the outer shield 106 to form a smaller internal cavity that is used for the components of the isolator 100, as further described below with reference to FIGS. 2A and 2B. The coupling/filtering member 118 can be formed of a conductive material, for example, a metal or metal alloy.

Figure 2A:
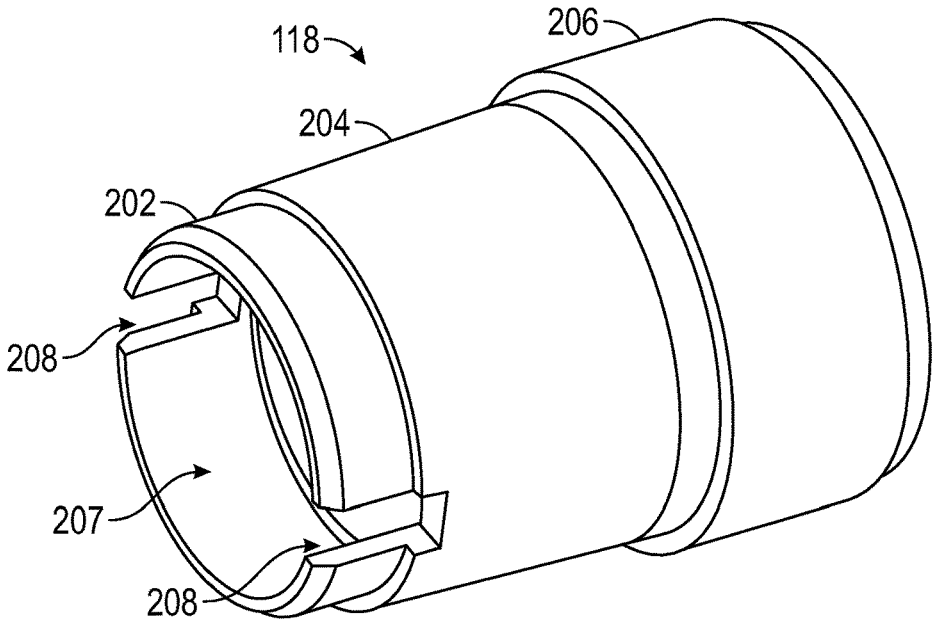
FIG. 2A illustrates a perspective view of an example of a filtering and coupling element, according to various implementations consistent with the present disclosure.

FIG. 2A illustrates an example of the filtering/coupling member 118, according to various implementations. As shown, filtering/coupling member 118 can be formed in a generally-cylindrical shape with increasing outer diameters 202, 204, and 206. The coupling/filtering member 118 can be hollow, forming a cavity 207 therein. The coupling/filtering member 118 can also include slots 208 proximal to an axial end thereof. The slots 208 may be configured to receive and hold a PCB assembly (e.g., PCB 120) stable, for example, to prevent such PCB assembly from rotating freely in the cavity 207 with respect to the filter/coupling member 118, or to be used as a ground contact for the PCB assembly.

Figure 2B:
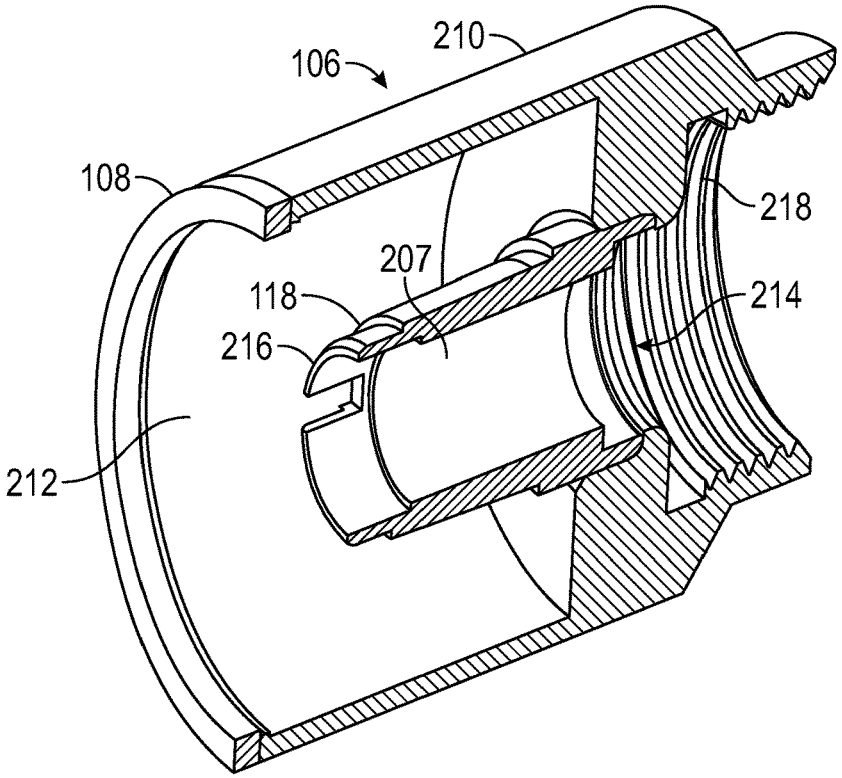
FIG. 2B illustrates a cutaway perspective view of an example of a filtering and coupling element, according to various implementations consistent with the present disclosure.

With continuing reference to FIG. 2A, FIG. 2B illustrates the filtering/coupling member 118 received into the outer shield 106. As shown, the outer shield 106 can be at least partially formed as a cylindrical member 210 including a first opening 212 and a second opening 214. The first and second openings 212, 214 may be axially oriented and separated apart. In an embodiment, the first opening 212 can define a larger diameter than the second opening 214. The second opening can be configured to receive the filtering/coupling member 118. Accordingly, the filtering/coupling member 118 can, in some embodiments, be received into the outer shield 106 through the first opening 212 and seated into the second opening 214. When the filtering/coupling member 118 is received into the second opening 214, an annular cavity 216 can be defined between (e.g., by) the outer shield 106 and the coupling/filtering member 118. The cylindrical member 210 can also include one or more (e.g., internal) threads 218 to receive a cable or device connected to the output of the isolator 100.

Returning to FIGS. 1A and 1B, the isolator 100 can include a PCB 120. The PCB 120 can be coupled between a PCB coupler 122 and an output pin 124. The PCB coupler 122 can be configured to receive a male pin from a device or cable connected to the connector 104. The output pin 124 can be configured to conduct signals to/from devices or cables connected to the isolator 100. The isolator 100 can include a support and sealing member 128 at or proximal to an axial end of the outer shield 106. The support and sealing member 128 can be formed in a cylindrical shape with a hole to receive the output pin 124. The support and sealing member 128 can be configured to hold the output pin 124 in place for connection of devices or cables to the isolation device 100.

The PCB 120 can be configured to condition signals passing from the PCB coupler 122 to the output pin 124. The PCB 120 can include any type of circuitry 126 to provide filtering and conditioning to the signals passing from the PCB coupler 122 to the output pin 124. For example, the PCB 120 can include one or more low-pass filters, bandpass filters, band reject filters, high-pass filters, amplifiers, diplexers, Multimedia over Coax Alliance (MoCA) filters, and the like. The PCB 120, the PCB coupler 122, and the output pin 124 comprise a RF signal transmission path through the coupling/filtering member 118 that conductively couples devices and/or cables connected at the input (e.g., connector 104) and the output (e.g., threads 218) of the isolator 100. In implementations, the PCB 120 (including the circuitry 126), the PCB coupler 122, and the output pin 124 can be combined into a single assembly.

In implementations, the isolator 100 includes a coaxial PCB 130. The coaxial PCB 130 can be configured to provide a connection between the body 102 and the filtering/coupling member 118 and the outer shield 106. While coaxial PCB 130 is illustrated as having cylindrical shape, the coaxial PCB 130 can be formed using other profiles (e.g., rectangular, triangular, oval, etc.).

Figure 3A:
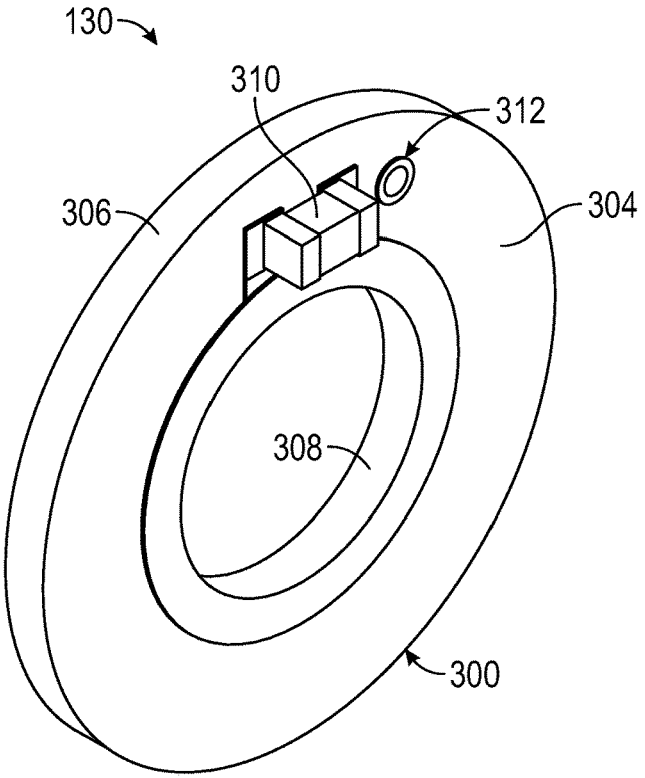
FIG. 3A illustrates a perspective view of an example of a coaxial printed circuit board (PCB), according to various implementations consistent with the present disclosure.
Figure 3B:
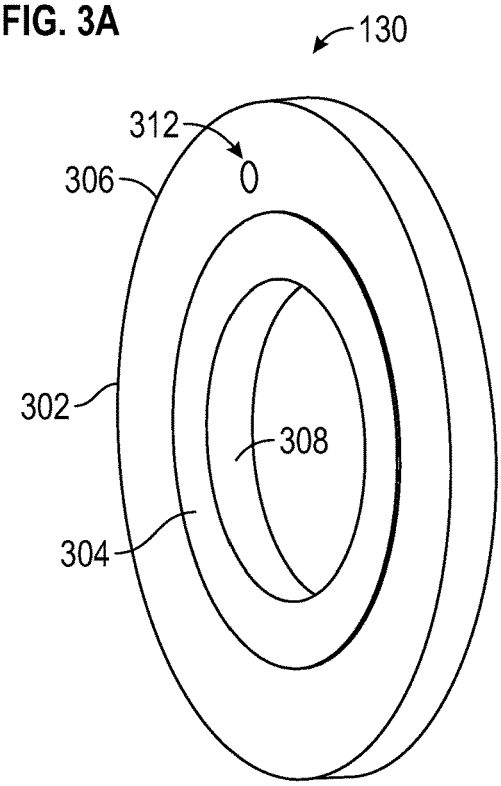
FIG. 3B illustrates a perspective view of an example of a coaxial PCB, according to various implementations consistent with the present disclosure.

FIGS. 3A and 3B illustrate examples of the coaxial PCB 130, according to various implementations. In particular, FIG. 3A illustrates a perspective view of a front 300 of the coaxial PCB 130, and FIG. 3B illustrates a perspective view of a rear 302 of the coaxial PCB 130. As illustrated, the coaxial PCB 130 can include an isolator ring 304 positioned between a outer conductor layer 306 and inner conductor layer 308. The isolator ring 304 can be formed of a dielectric material, for example, a plastic insulator. The outer conductor layer 306 and the inner conductor layer 308 can be formed of a conductor material, for example, a metal or metal alloy. The outer conductor layer 306 may be positioned at or proximal to an outer diameter of the PCB 130, and the inner conductor layer 308 may be positioned at or proximal to an inner diameter thereof.

The coaxial PCB 130 can include one or more surface mounted circuits 310 (e.g., a surface mounted technology (SMT) circuit) placed on the isolator ring 304 and a plated via a hole 312 formed axially in (e.g., through) the isolator ring 304. The plated via hole 312 can be formed at least partially from conductor material, for example, a metal or metal alloy. In some implementations, for example, the one or more surface mounted circuits 310 can include capacitive circuits, inductive circuits, resistive circuits, filtering circuits, and the like. The outer conductor layer 306 and the inner conductor layer 308 can be electrically coupled through the one or more surface mounted circuits 310.

Figure 3C:
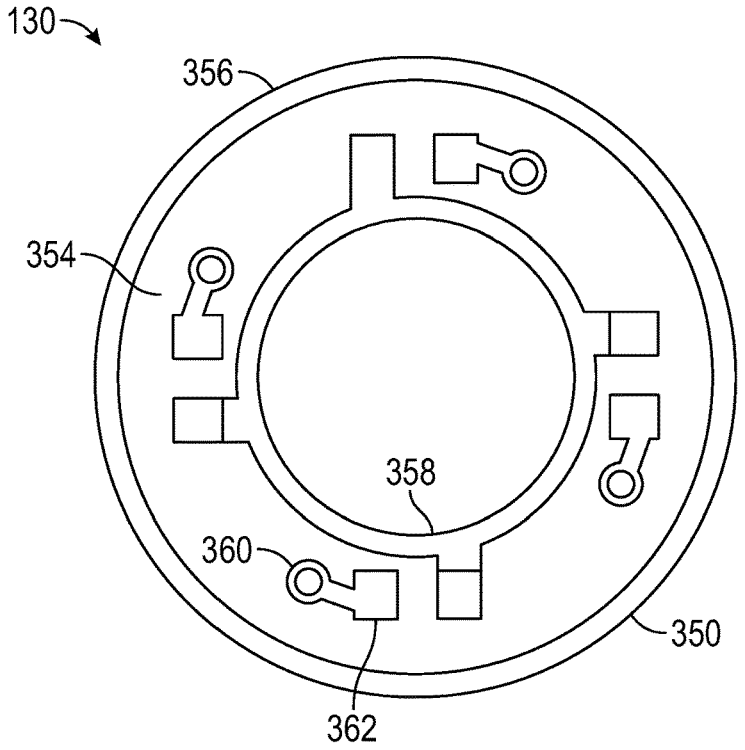
FIG. 3C illustrates a front view of an example of a coaxial PCB, according to various implementations consistent with the present disclosure.
Figure 3D:
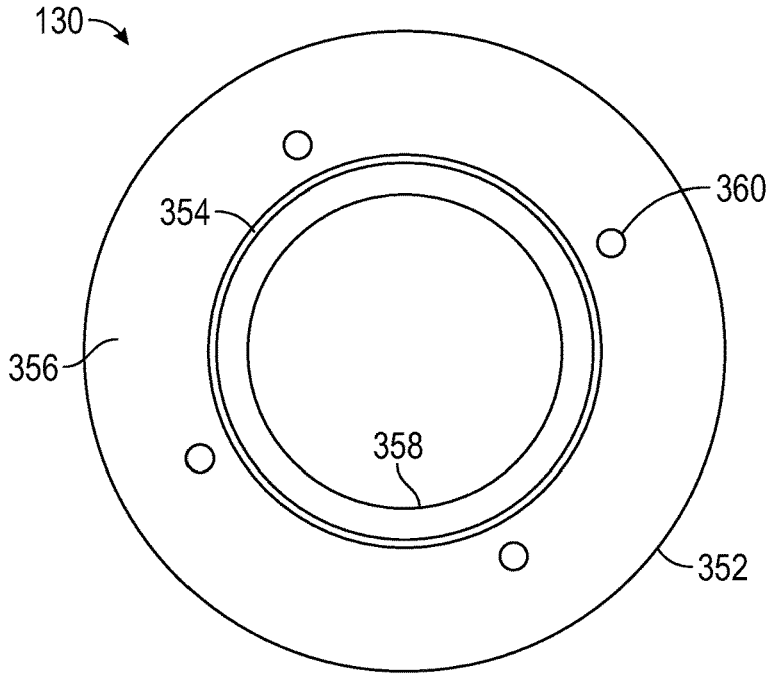
FIG. 3D illustrates a rear view of an example of a coaxial PCB, according to various implementations consistent with the present disclosure.

FIGS. 3C and 3D illustrate examples of another example of coaxial PCB 130, according to various implementations. In particular, FIG. 3C illustrates a view of a front 350 of the coaxial PCB 30, and FIG. 3D illustrates a view of a rear 352 of the coaxial PCB 130. The coaxial PCB 130 can include an isolator ring 354 positioned between two layers: an outer conductor layer 356 and an inner conductor layer 358. The top layer 356 can include one or more surface mounted circuit footprints 362 (e.g., four footprints), which can receive one or more surface mounted circuits. The isolator ring 354 can be formed of a dielectric material, for example, a plastic insulator. The outer conductor layer 356 and the inner conductor layer 358 can be formed of a conductor material, for example, a metal or metal alloy.

The coaxial PCB 130 illustrated in FIGS. 3C and 3D can include one or more surface mounted circuits (not shown) placed on the isolator ring 354 and one or more plated via holes 360 formed in the isolator ring 304 and electrically coupled to the circuit footprints 362. The plated via holes 360 can be formed of a conductor material, for example, a metal or metal alloy. The outer conductor layer 356 and the inner conductor layer 358 can be electrically coupled through the one or more surface mounted circuits.

Returning to FIGS. 1A and 1B, in some implementations the coaxial PCB 130 illustrated in FIGS. 3C and 3D can function as a filter that blocks direct current ("DC") flow between the body 102, and the outer shield 106 and coupling/filtering member 118 by deploying capacitive coupling elements such as capacitors. For example, the coaxial PCB 130 can be placed in the isolator 100 so that the outer conductor layer 306 (or the outer conductor layer 356) is in electrical contact with the body 102 and the inner conductor layer 308 (or inner conductor layer 358) is in electrical contact with the coupling/filtering member 118. For example, the inner diameter of the coaxial PCB 130 can be configured to fit over any of the diameters 202, 204, and 206 of the coupling/filtering member 118 depending on the configuration of the isolator 100, as further discussed below in reference to FIGS. 4A-4D.

Still referring to FIGS. 1A and 1B, the isolator 100 can include one or more toroids 132 configured to filter and/or attenuate RF signal ingress into the isolator 100 or RF signal egress from the isolator 100 that may be induced by signals traveling through the isolator 100. The toroids 132 can be formed of a magnetic material (e.g., ferrite) having for example, a cylindrical shape. In accordance with aspects of the present disclosure, the one or more toroids 132 can be positioned axially adjacent to the coaxial PCB 130 and surrounding a portion of the coupling/filtering member 118 within the EMI filtering cavity (e.g., inner cavity 216). In implementations, the inner diameter of the toroid 132 can be formed to any of the diameters 202, 204, 206 of the coupling/filtering member 118.

In implementations, the isolator 100 incudes a support member 134 configured to hold the PCB coupler 122 in place for connection of devices or cables to the input of the isolation device 100 at the connector 104. The support member 134 can be formed in a cylindrical shape with a hole to receive the PCB coupler 122 and sized to fit within a diameter of the connector 104.

Further, implementations of the isolator 100 can include a compression member 136 configured to provide axially-directed force on the components of the isolator 100 to improve the mechanical connections of the components. For example, the compression member 136 can be configured to provide force on the coaxial PCB 130 and/or the toroid 132. In some implementations, for example, the compression member 136 can be a spring or any other resilient member.

Figure 4A:
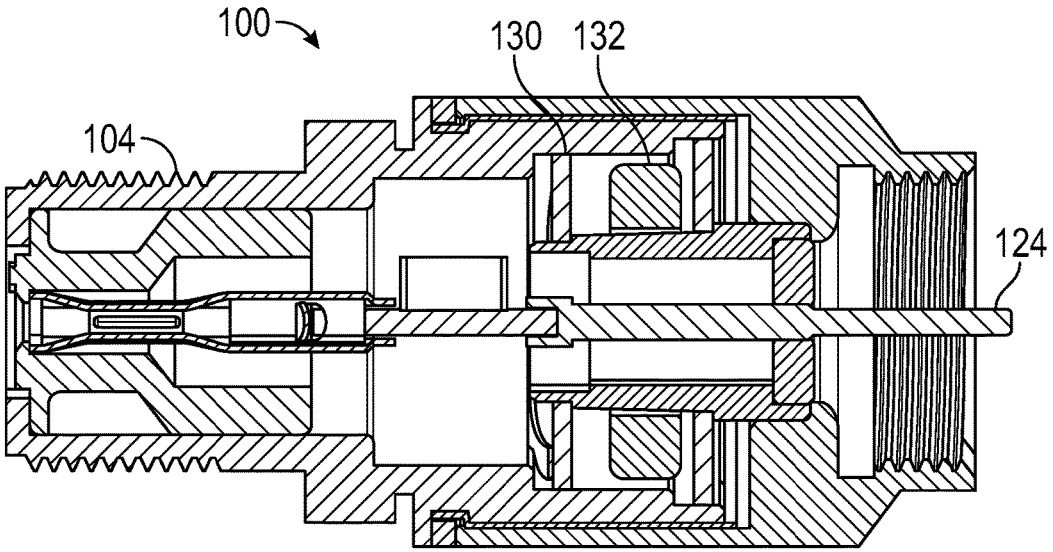
FIG. 4A illustrates a cutaway side view of an example of an isolator, according to various implementations consistent with the present disclosure.

FIG. 4A illustrates a cutaway side view of an example of the isolator 100 according to various implementations. As shown, the toroid 132 can be positioned after the coaxial PCB 130. For example, the toroid 132 can be "after" the PCB 130 in that the toroid 132 is positioned on an axial side of the isolator 100, around the output pin 124, such that the toroid 132 is farther from the connector 104 than the coaxial PCB 130. In other implementations, the positioning of the toroid 132 and the coaxial PCB 130 can be reversed, as shown in FIG. 1A, for example.

Figure 4B:
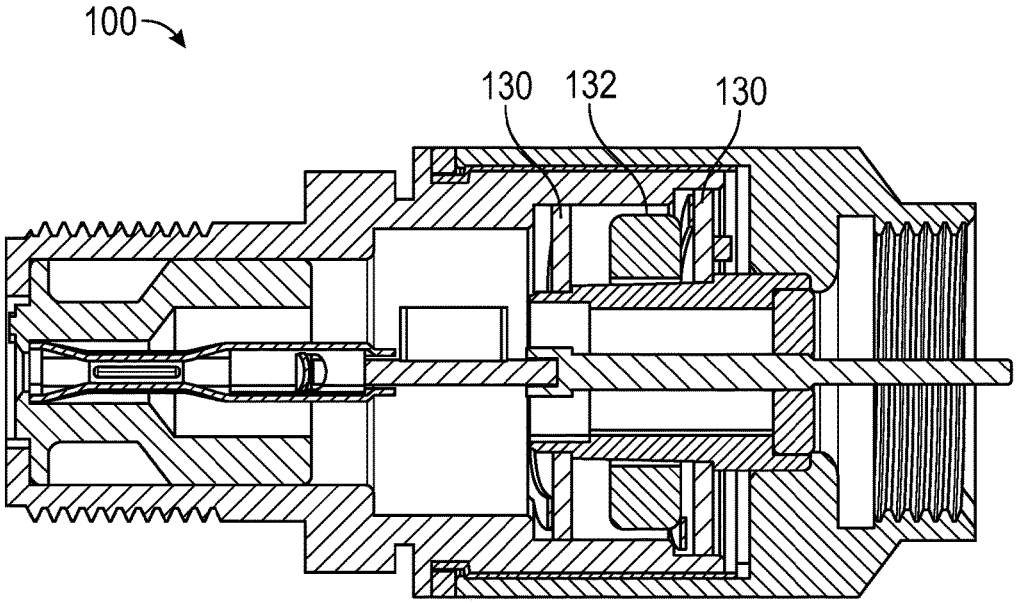
FIG. 4B illustrates a cutaway side view of an example of an isolator, according to various implementations consistent with the present disclosure.

FIG. 4B illustrates a cutaway side view of an example of the isolator 100 according to another implementation. In this implementation, the toroid 132 is placed between two coaxial PCBs 130. In some implementations, the isolator 100 can include two different versions of the coaxial PCB 130. For example, one of the coaxial PCBs 130 can be the coaxial PCB 130 of FIG. 3A and the other can be the coaxial PCB 130 of FIG. 3B. In other implementations, the coaxial PCBs 130 of FIG. 4B can both be versions of either of the coaxial PCBs 130 shown in FIGS. 3A or 3B. Moreover, the two coaxial PCBs 130 can include the surface mounted circuits 310, different surface mounted circuits 310, or combinations thereof.

Figure 4C:
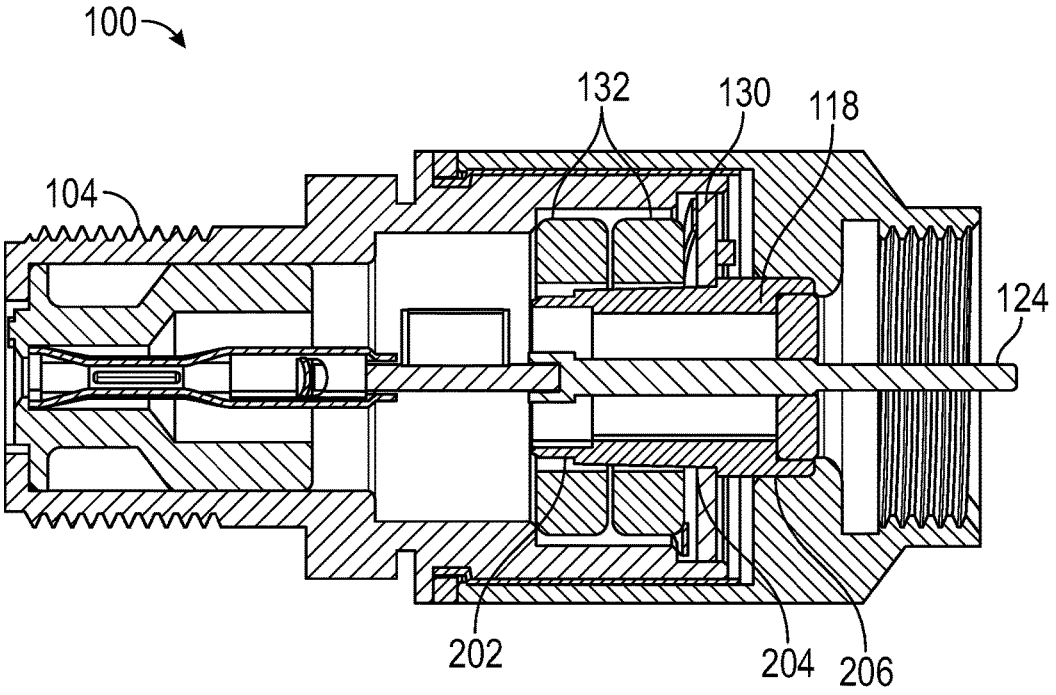
FIG. 4C illustrates a cutaway side view of an example of an isolator, according to various implementations consistent with the present disclosure.

FIG. 4C illustrates a cutaway side view of an example of the isolator 100 according to various implementations. As illustrated, the isolator 100 can include two toroids 132. For example, the toroids 132 can be positioned along the axis of the isolator 100, around the coupling/filtering member 118 and the output pin 124. For example, an inner diameter of the toroids 132 can be formed to fit over the diameters 202 and 204 of the coupling/filtering member 118. The isolator 100 can also include coaxial PCB 130 positioned along the axis of the isolator 100, around the coupling/filtering member 118 and the output pin 124, such that the coaxial PCB 130 is farther from the connector 104 than the toroids 132. For example, the coaxial PCB 130 can be the coaxial PCB 130 as described in FIG. 3A. The coaxial PCB 130 can also be the coaxial PCB 130, as described in FIG. 3B. While FIG. 4C illustrates the positioning of the toroids 132 and the coaxial PCB 130, in some implementations, the positioning of the toroids 132 and the coaxial PCB 130 can be reversed.

Figure 4D:
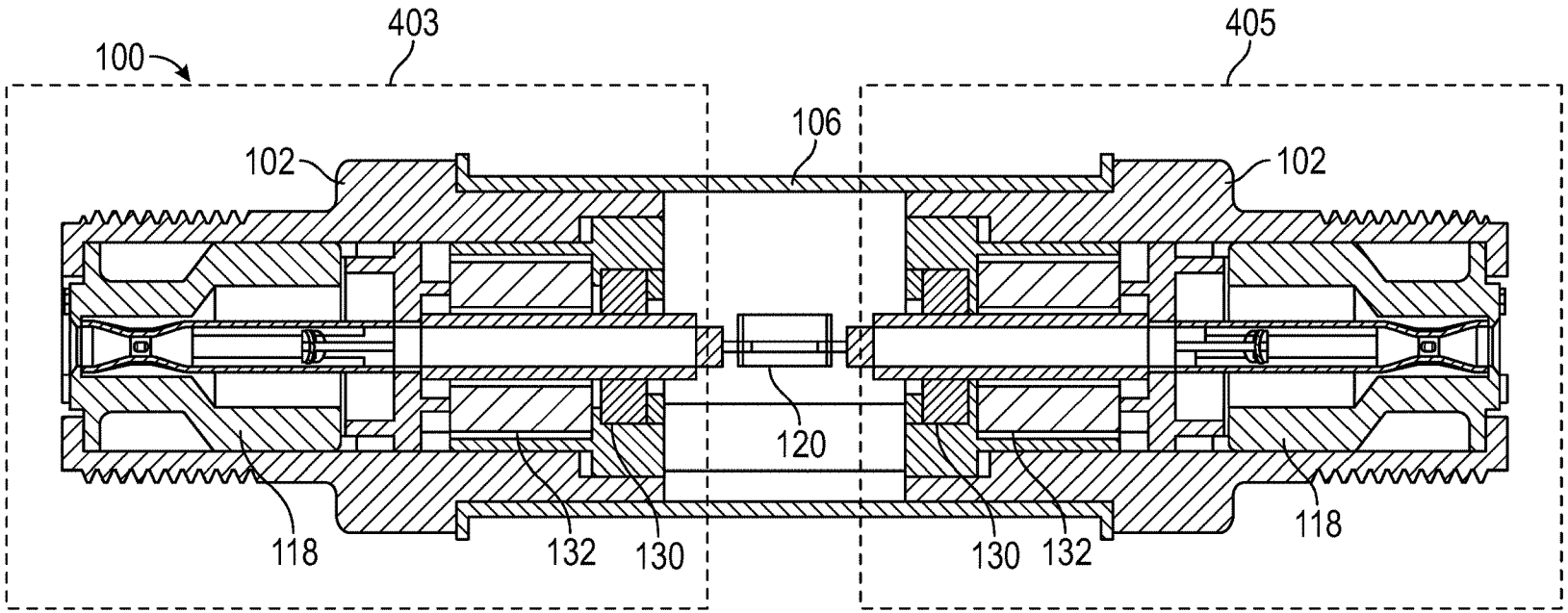
FIG. 4D illustrates a cutaway side view of an example of an isolator, according to various implementations consistent with the present disclosure.

FIG. 4D illustrates a cutaway side view of an example of an isolator according to various implementations. As shown, implementations of the isolator 100 can include a symmetrical sides 403 and 405. For example, as illustrated, the isolator 100 can include two female input sides with the PCB 120 coupled between. In this example, each side of the sides 403 and 405 can include a body 102, an outer shield 106, and a coupling/filtering member 118. Additionally, each side can include one or more coaxial PCBs 130 and one or more toroids 132. For example, each side of the isolator 100 can includes a configuration of one or more coaxial PCB 130 and one or more toroids 132, as described above in FIGS. 4A-4C. In the implementations discussed above, the isolator 100 can be designed and configured to address any type of application.

Figure 5:
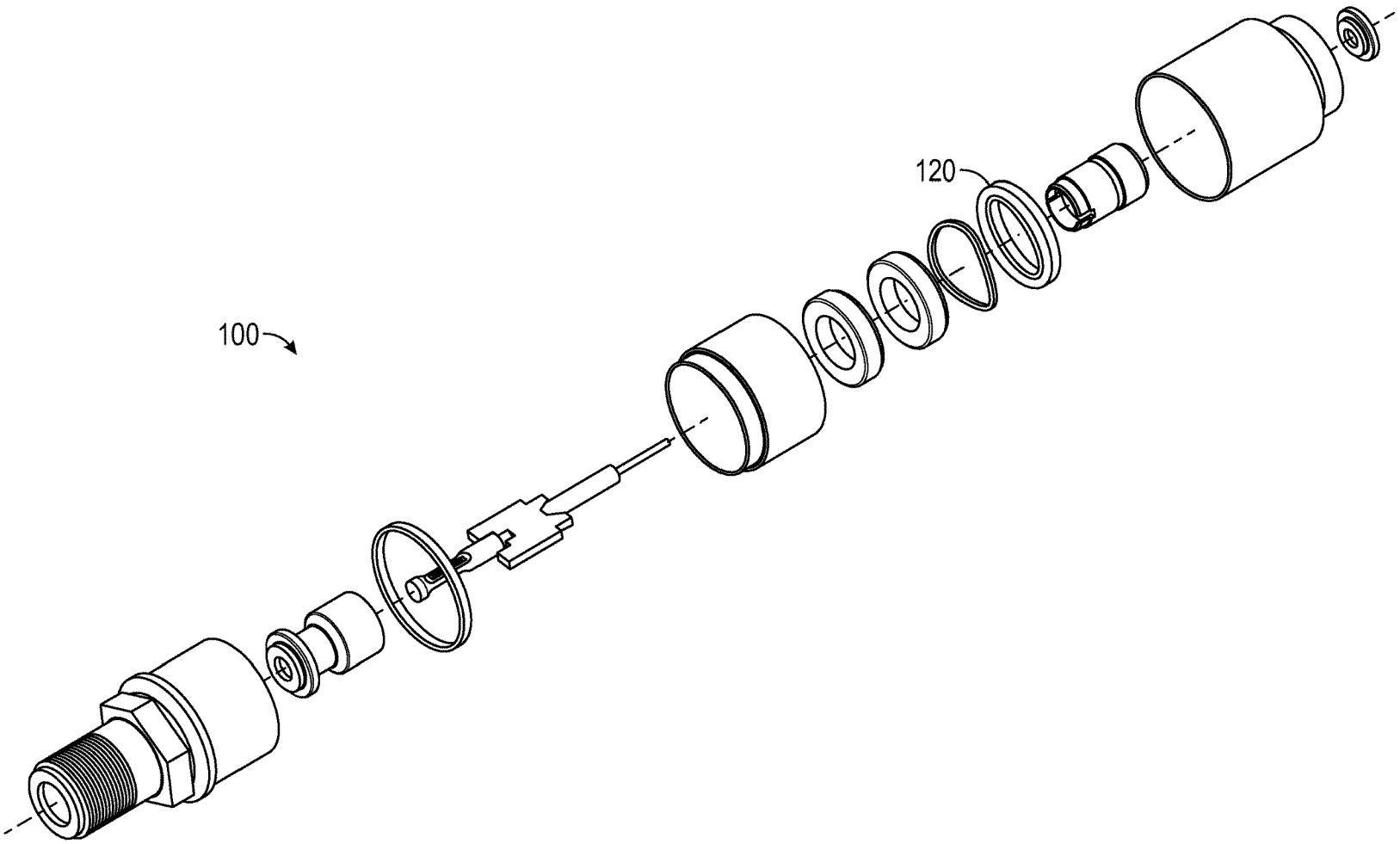
FIG. 5 illustrates an exploded perspective of an example of an isolator, according to various implementations consistent with the present disclosure.

FIG. 5 illustrates an exploded perspective of an example of an isolator 100, according to various implementations consistent with the present disclosure. The various components of the isolator 100 illustrated in the examples shown in FIG. 5 can be the same or similar to those previously described herein. As illustrated in FIG. 5, the isolator 100 can include a PCB 120 that provides signal conditioning for a Multimedia over Coax Alliance (MoCA) signals. For example, in some implementations, the PCB 120 can include a one or more RF filters where a passband is 5 MHz-1002 MHz and a reject band is 1125 MHz to 1675 MHz ii). For example, in some implementations, the PCB 120 can include a one or more filters where a passband is 5 MHz-1194 MHz and a reject band is 1218 MHz to 1675 MHz.

Figure 6A:
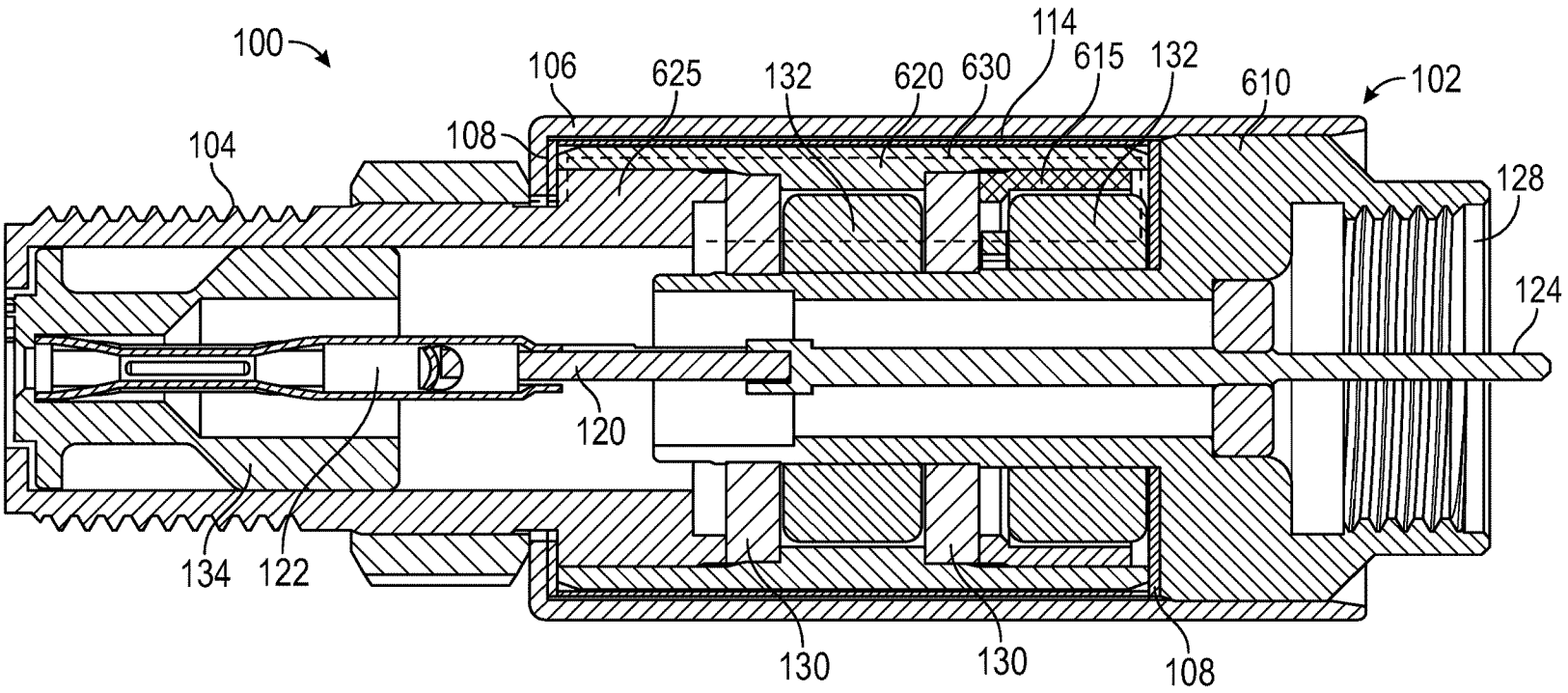
FIG. 6A illustrates a cutaway side view of an example of an isolator, according to various implementations consistent with the present disclosure.
Figure 6B:
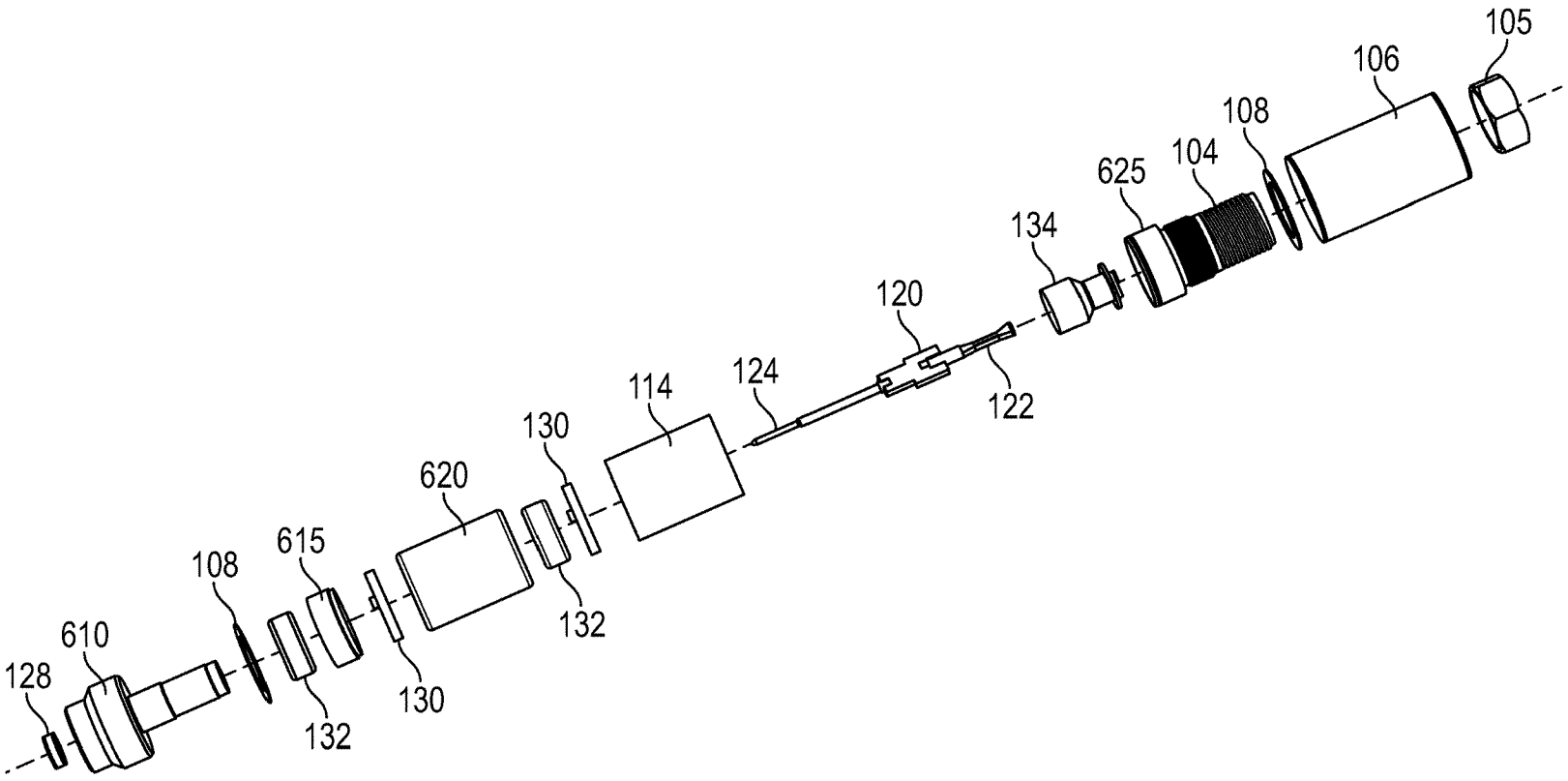
FIG. 6B illustrates a cutaway side view of an example of an isolator, according to various implementations consistent with the present disclosure.

FIGS. 6A and 6B illustrate examples of another example of an isolator 100, according to various implementations consistent with the present disclosure. FIG. 6A illustrates a cutaway side view of an example of the isolator 100, and FIG. 6B illustrates an exploded perspective view of an example of the isolator 100. The various components of the isolator 100 illustrated in the examples shown in FIGS. 6A and 6B can be the same or similar to those previously described herein. In accordance with aspects of the present disclosure, the isolator 100 illustrated in FIGS. 6A and 6B combines coupling/filtering member (e.g., coupling/filtering member 118 and cylindrical member 210) into a single element, connector/filtering member 610. Accordingly, instead of assembling the isolator 100 by compressing a coupling/filtering member (e.g., coupling/filtering member 118) and the cylindrical member (e.g., cylindrical member 210), implementations consistent with FIGS. 6A and 6B provide a unitary connector/filtering member 610 configured to be solely compression-fitted into an outer shield 106 such that the connector/filtering member 610 securely mates with the outer shield 106, e.g., without additional physical couplings (e.g., mechanical or adhesive).

Additionally or alternatively, the body 102 can be comprised of three separate elements: first body element 615, second body element 620, and third body element 625 configured to be press-fit together during assembly of the isolator 100. In accordance with aspects of the present disclosure, the body 102 is configured to provide electrical isolation of the isolator 100 via insulative sleeve 114, and EMI filtering via and coaxial PCBs 130 and toroids 132.

In implementations of the isolator 100 illustrated in FIGS. 6A and 6B, there are at least two coaxial PCBs 130 and at least two toroids 132 arranged in alternating positions along the central axis of the isolator (e.g., toroid 132—coaxial PCB 130—toroid 132—coaxial PCB 130, or vice versa). As illustrated in FIG. 6A, such physical arrangement inside the outer shield 106 and the sleeve 114 provides a U-shaped signal channel 630 along the sleeve 114, coaxial PCBs 130 and the toroids 132. Doing so increases EMI filtering of the isolator 100 by eliminating any straight signal paths (e.g., perpendicular to the axis of the outer shield 106) between the body 102 and the components (e.g., surface mounted circuits 310) of the coaxial PCBs 130.

In accordance with aspects of the present disclosure, the connector/filtering member 610, the first body element 615, second body element 620, and third body element 625 can be securely press-fit together during manufacture without using any solder or adhesives. For example, the following elements can be serially assembled within the outer shield 106: a spacer 108, connector 104 and body element 625, threaded nut 105, support member 134, PCB coupler 122, PCB 120, output pin 124; sleeve 114, a coaxial PCB 130, a toroid 132, body element 620, a coaxial PCB 130, body element 625, toroid 132, a spacer 108, connector/filtering member 610, and support and sealing member 128. As discussed previously, the connector/filtering member 610 can be configured to be securely press-fitted into an outer shield 106 to hold the securely hold the forgoing elements of the isolator 100. While the elements are described as being assembled in a particular order, it is understood the some of the elements can be assembled together before being assembled. For example, the PCB coupler 122, PCB 120, and the output pin 124 can be assembled prior to insertion into the support member 134. The assembled elements, as shown in FIG. 6A, provide an isolator 100 having a small size, simple assembly, and minimal RF leakage with respect to similar devices.

While the teachings have been described with reference to examples of the implementations thereof, those skilled in the art will be able to make various modifications to the described implementations without departing from the true spirit and scope. The terms and descriptions used herein are set forth by way of illustration only and are not meant as limitations. In particular, although the method has been described by examples, the steps of the method may be performed in a different order than illustrated or simultaneously. Furthermore, to the extent that the terms "including", "includes", "having", "has", "with", or variants thereof are used in either the detailed description and the claims, such terms are intended to be inclusive in a manner similar to the term "comprising." As used herein, the terms "one or more of" and "at least one of" with respect to a listing of items such as, for example, A and B, means A alone, B alone, or A and B. Further, unless specified otherwise, the term "set" should be interpreted as "one or more." Also, the term "couple" or "couples" is intended to mean either an indirect or direct connection. Thus, if a first device couples to a second device, that connection may be through a direct connection, or through an indirect connection via other devices, components, and connections.

What is claimed is:

1. A coaxial radio frequency (RF) isolator comprising:

a first connector configured to conduct an RF signal received from a first device connected to the isolator;

a conductive body comprising a second connector and a conductive outer shield, wherein the conductive body and the conductive outer shield form a first internal cavity;

a dielectric sleeve between the outer shield and the conductive body;

a conductive coupling/filtering member inside the outer shield and the dielectric sleeve, the conductive coupling/filtering member having a cylindrical shape forming a second internal cavity;

a thru-RF signal transmission path through the first internal cavity and the second internal cavity, the thru-RF signal transmission path configured to receive the RF signal from the first device, condition the RF signal, and output the RF signal to a second device;

a coaxial coupling element in the first internal cavity and comprising a cylindrical shape, the coaxial coupling element connecting the conductive body, the conductive filtering/coupling member, and the conductive outer shield;

a magnetic toroid in the first internal cavity surrounding the conductive coupling/filtering member; and a compression member configured to apply force to the coaxial coupling element and the magnetic toroid.

2. The isolator of claim 1, wherein the thru-RF signal transmission path comprises an RF filter device.

3. The isolator of claim 1, wherein the coaxial coupling element comprises a DC filter device.

4. The isolator of claim 1, wherein the magnetic toroid comprises a cylindrical shape having an inner diameter corresponding to an outer diameter of the conductive coupling/filtering member.

5. The isolator of claim 1, wherein the conductive body comprises a unitary body forming the second connector and the conductive outer shield.

6. The isolator of claim 1, wherein the conductive body is configured to connect between the conductive coupling/filtering member and the second device.

7. The isolator of claim 1, wherein:

the first connector is configured to receive a connector of the first device; and the second connector is configured to receive a connector of the second device.

8. The isolator of claim 1, further comprising a compression member configured to apply force to the coaxial coupling element and the magnetic toroid.

9. An isolator comprising:

a body comprising an input connector and an output connector;

an outer shield positioned at least partially around a portion of the body;

a coupling member electrically coupled to the outer shield and positioned within the outer shield, wherein a cavity is formed by the outer shield and the coupling member;

a coaxial circuit comprising a circuit board that is positioned at least partially around a first portion of the coupling member within the cavity;

a toroid configured to filter radio frequency (RF) signals surrounding a second portion of the coupling member and positioned within the cavity; and a conditioning circuit in communication with the input connector and the output connector, wherein the conditioning circuit is configured to condition signals communicated between the input connector and the output connector.

10. The isolator of claim 9, further comprising a sleeve positioned between the outer shield and the portion of the body.

11. The isolator of claim 9, wherein the coaxial circuit electrically couples the coupling member and the body.

12. The isolator of claim 9, wherein the conditioning circuit comprises one or more of a high pass filter, a low pass filter, an amplifier, a bandpass filter, a band reject filter, or a Multimedia over Coax Alliance (MoCA) circuit.

13. The isolator of claim 9, wherein:

the input connector is configured to receive a connector of a first device that provides an input signal to the isolator; and the output connector is configured to receive a connector of a second device that receives an output signal from the isolator.

14. The isolator of claim 9, wherein the coaxial circuit comprises a circuit board.

15. The isolator of claim 9, wherein the coaxial circuit comprises:

an insulator ring;

a first conductor layer formed on an outer surface of the insulator ring;

a second conductor layer formed on an inner surface of the insulator ring; and one or more electrical circuits positioned on the insulator ring and electrically coupled between the first conductor layer and the second conductor layer.

16. The isolator of claim 15, wherein the coaxial circuit comprises a printed circuit board.

17. The isolator of claim 15, wherein the one or more electrical circuits comprise one or more of a capacitive circuit, an inductive circuit, a resistive circuit, or a filtering circuit.

18. The isolator of claim 9, further comprising a second coaxial circuit surrounding a third portion of the coupling member within the cavity.

19. The isolator of claim 18, further comprising a second toroid surrounding the third portion of the coupling member within the cavity.

20. The isolator of claim 19, wherein:

the toroid is between the coaxial circuit and the second coaxial circuit; and the second coaxial circuit is between the toroid and the second toroid.

21. The isolator of claim 9, wherein the output connector and the outer shield comprise a unitary conductive body.

22. The isolator of claim 21, wherein the conductive body is configured to connect between the coupling member and a second device that receives an output of the isolator.

23. An isolator comprising:
an outer shield;
an input connector;
an output connector;
a conditioning circuit configured to condition signals communicated between the input connector and the output connector;
a coupling member electrically connected to the output connector;
a coaxial circuit electrically connecting the outer shield to the coupling member, wherein the coaxial circuit is configured to provide ground isolation between the input connector and the output connector; and
a compression member configured to apply force to the coaxial circuit.

24. The isolator of claim 23, wherein:
the input connector is configured to receive a connector of a first device that provides an input signal to the isolator; and
the output connector is configured to receive a connector of a second device that receives an output signal from the isolator.

25. The isolator of claim 23, further comprising a compression member configured to apply force to the coaxial circuit.

26. The isolator of claim 23, wherein the second connector and the outer shield comprise a unitary conductive body.

27. The isolator of claim 26, wherein the conductive body is configured to connect between the coupling member and a second device connected to the output connector.

28. The isolator of claim 23, further comprising at least one magnetic toroid positioned axially adjacent to the coaxial circuit, wherein:
the coaxial circuit surrounds a first portion of the coupling member; and
the at least one magnetic toroid surrounds a second portion of the coupling member.

29. The isolator of claim 28, wherein the coaxial circuit comprises:
an insulator ring;
a first conductor layer formed on an outer surface of the insulator ring;
a second conductor layer formed on an inner surface of the insulator ring; and
one or more electrical circuits positioned on the insulator ring and electrically coupled between the first conductor layer and the second conductor layer.

30. The isolator of claim 29, wherein:
the one or more electrical circuits comprise one or more of a capacitive circuit, an inductive circuit, a resistive circuit, and a filtering circuit;
the coaxial circuit is a printed circuit board having a cylindrical shape; and
the first circuit comprises one or more of a high pass filter, a low pass filter, an amplifier, a bandpass filter, a band reject filter, and a Multimedia over Coax Alliance (MoCA) circuit.

31. A coaxial radio frequency (RF) isolator comprising:
a first connector configured to conduct an RF signal received from a first device connected to the isolator;
a conductive body comprising a second connector and a conductive outer shield, wherein the conductive body and the conductive outer shield form a first internal cavity;
a dielectric sleeve between the outer shield and the conductive body;
a conductive coupling/filtering member inside the outer shield and the dielectric sleeve, the conductive coupling/filtering member having a cylindrical shape forming a second internal cavity;
a thru-RF signal transmission path through the first internal cavity and the second internal cavity, the thru-RF signal transmission path configured to receive the RF signal from the first device, condition the RF signal, and output the RF signal to a second device;
a coaxial coupling element in the first internal cavity and comprising a cylindrical shape, the coaxial coupling element connecting the conductive body, the conductive filtering/coupling member, and the conductive outer shield; and
a magnetic toroid in the first cavity surrounding the conductive coupling/filtering member,
wherein:
the thru-RF signal transmission path comprises the first connector, a first circuit board, and the second connector; and
the coaxial coupling element comprises a second circuit board surrounding the conductive coupling/filtering member.

32. An isolator comprising:
a body comprising an input connector and an output connector;
an outer shield positioned at least partially around a portion of the body;
a coupling member electrically coupled to the outer shield and positioned within the outer shield, wherein a cavity is formed by the outer shield and the coupling member;
a coaxial circuit positioned at least partially around a first portion of the coupling member within the cavity;
a toroid configured to filter RF signals surrounding a second portion of the coupling member and positioned within the cavity;
a compression member configured to apply force to the coaxial circuit and the toroid; and
a conditioning circuit in communication with the input connector and the output connector, wherein the conditioning circuit is configured to condition signals communicated between the input connector and the output connector.

33. An isolator comprising:
an outer shield,
an input connector,
an output connector;
a conditioning circuit configured to condition signals communicated between the input connector and the output connector;
a coupling member electrically connected to the output connector; and
a coaxial circuit electrically connecting the outer shield to the coupling member,
wherein:
the coaxial circuit is a printed circuit board having a cylindrical shape and surrounds the coupling member, and
the coaxial circuit is configured to provide ground isolation between the input connector and the output connector.

34. An isolator comprising:
an outer shield;
an input connector;
an output connector;
a conditioning circuit configured to condition signals communicated between the input connector and the output connector, wherein the conditioning circuit comprises one or more of a high pass filter, a low pass filter, an amplifier, a bandpass filter, a band reject filter, and a Multimedia over Coax Alliance (MoCA) circuit;

a coupling member electrically connected to the output connector;

a coaxial circuit electrically connecting the outer shield to the coupling member, wherein the coaxial circuit is configured to provide ground isolation between the input connector and the output connector, wherein the coaxial circuit is a printed circuit board having a cylindrical shape, and wherein the coaxial circuit comprises:

an insulator ring;

a first conductor layer formed on an outer surface of the insulator ring;

a second conductor layer formed on an inner surface of the insulator ring; and one or more electrical circuits positioned on the insulator ring and electrically coupled between the first conductor layer and the second conductor layer, wherein the one or more electrical circuits comprise one or more of a capacitive circuit, an inductive circuit, a resistive circuit, and a filtering circuit; and a magnetic toroid positioned axially adjacent to the coaxial circuit, wherein the coaxial circuit surrounds a first portion of the coupling member, and the at least one magnetic toroid surrounds a second portion of the coupling member.

* * * * *